US011795656B2

(12) United States Patent
Zuniga

(10) Patent No.: US 11,795,656 B2
(45) Date of Patent: Oct. 24, 2023

(54) SPECIALTY CONCRETE REMOVER

(71) Applicant: Tomas Zuniga, Detroit, MI (US)

(72) Inventor: Tomas Zuniga, Detroit, MI (US)

( * ) Notice: Subject to any disclaimer, the term of this patent is extended or adjusted under 35 U.S.C. 154(b) by 652 days.

(21) Appl. No.: 16/945,685

(22) Filed: Jul. 31, 2020

(65) Prior Publication Data

US 2020/0362534 A1 Nov. 19, 2020

Related U.S. Application Data

(63) Continuation-in-part of application No. 16/870,937, filed on May 9, 2020, now abandoned.

(60) Provisional application No. 62/845,805, filed on May 9, 2019.

(51) Int. Cl.

| | |
|---|---|
| ***E02F 3/96*** | (2006.01) |
| ***E02F 3/32*** | (2006.01) |
| ***E01C 23/09*** | (2006.01) |
| ***E02F 3/413*** | (2006.01) |
| ***E02F 3/36*** | (2006.01) |

(52) U.S. Cl.

CPC ..... *E02F 3/963* (2013.01); *E01C 23/09* (2013.01); *E02F 3/32* (2013.01); *E02F 3/3677* (2013.01); *E02F 3/4135* (2013.01); *E02F 3/965* (2013.01)

(58) Field of Classification Search

CPC . E02F 3/963; E02F 3/32; E02F 3/3677; E02F 3/4135; E02F 3/965; E01C 19/05; E01C 23/09

See application file for complete search history.

(56) References Cited

U.S. PATENT DOCUMENTS

| | | | | | |
|---|---|---|---|---|---|
| 2,857,690 | A * | 10/1958 | Yake | E02F 3/60 | 37/301 |
| 3,026,865 | A * | 3/1962 | Sunada | B28D 1/222 | 125/23.01 |
| 3,542,435 | A * | 11/1970 | Herrmann | E02F 3/401 | 414/724 |
| 3,980,341 | A * | 9/1976 | Musannif | E02F 3/965 | 241/101.73 |
| 4,153,301 | A * | 5/1979 | Armstrong | E02F 3/965 | 241/1 |
| 4,188,721 | A * | 2/1980 | Ramun | B23D 17/06 | 144/34.5 |
| 4,450,625 | A * | 5/1984 | Ramun | E02F 3/964 | 83/609 |

(Continued)

*Primary Examiner* — Jamie L McGowan

(74) *Attorney, Agent, or Firm* — CHRISTOPHER P. MAIORANA, P.C.

(57) ABSTRACT

A concrete removing apparatus comprises a claw, a cleaving blade, and a bracket. The claw generally has a lower portion, a back portion, and an upper portion. The lower portion generally has a bottom surface, a sloped top surface, and extends forward from the back portion. The upper portion generally extends forward from the back portion partially overhanging the bottom portion and forming a locking notch defined by a front edge of the back portion, a bottom surface of the upper portion, and the top surface of the bottom portion. The cleaving blade is generally attached to a rear surface of the back portion of the claw. The bracket is generally mounted on a top surface of the upper portion of the claw and configured to pivotally connect the bracket to an arm and a hydraulic cylinder of a construction machine.

13 Claims, 12 Drawing Sheets

(56) References Cited

U.S. PATENT DOCUMENTS 4,657,307 A * 4/1987 Staley ..... E01C 23/121 404/90
4,719,975 A * 1/1988 LaBounty ..... E02F 3/966 414/740
5,179,985 A * 1/1993 Pallari ..... E02F 3/965 83/609
5,184,934 A * 2/1993 Gallo ..... B66F 9/18 125/35
5,515,620 A * 5/1996 Butler ..... F26B 11/0477 432/118
6,311,417 B1 * 11/2001 Pratt ..... E02F 3/962 37/454
6,517,164 B1 * 2/2003 White ..... E02F 5/326 37/447
6,520,592 B1 * 2/2003 Bobholz ..... E01C 23/121 173/100
6,601,891 B1 * 8/2003 Gregory, Jr. ..... B66C 1/585 294/197
6,764,139 B1 * 7/2004 Wortman ..... E04G 23/08 299/95
8,506,018 B1 * 8/2013 Navarro ..... B28D 7/043 299/37.3
9,414,704 B1 * 8/2016 Lindley ..... A47G 25/80
2004/0187362 A1 * 9/2004 Harding ..... E02F 3/7609 37/403
2004/0223838 A1 * 11/2004 Daniel ..... E02F 3/965 414/739
2004/0255737 A1 * 12/2004 Sakato ..... B23D 31/008 83/13
2005/0115638 A1 * 6/2005 Solesbee ..... E02F 3/404 144/4.1
2010/0206975 A1 * 8/2010 Ueda ..... E02F 3/965 241/283
2011/0000108 A1 * 1/2011 Horton ..... E02F 9/2858 37/444
2016/0061230 A1 * 3/2016 Jacobson ..... E02F 9/0833 60/487
2019/0193084 A1 * 6/2019 Brouwers ..... B02C 1/10
2020/0023371 A1 * 1/2020 Brunou ..... B02C 1/005
2020/0086326 A1 * 3/2020 Johnson ..... E02F 3/965
2020/0362534 A1 * 11/2020 Zuniga ..... E02F 3/963

* cited by examiner

SPECIALTY CONCRETE REMOVER

This application relates to U.S. Ser. No. 16/870,937, filed May 9, 2020, which relates to U.S. Provisional Application No. 62/845,805, filed May 9, 2019, which are hereby incorporated by reference in their entirety.

FIELD OF THE INVENTION

The invention relates to concrete construction machines generally and, more particularly, to a method and/or apparatus for implementing a specialty concrete remover.

BACKGROUND

A conventional excavator bucket includes a bucket section which has a bottom surface extending to digging pawls. When the bucket is used to dig up paved asphalt below which soil lies as a sublayer, the pawls of the bucket deeply enter the soil and the subsequent upward swinging of the bucket digs up only soil and fails to strip and lift the asphalt. Furthermore, when the asphalt lies on a rigid sublayer such as concrete, the pawls strike against the sublayer and are prevented from penetrating it, and the pawls only make holes in the asphalt and fail to accomplish the stripping and digging. Thus, the conventional bucket apparatus is typically used to strip and dig up the asphalt and concrete after it is crushed to pieces of a sufficient size by using a suitable tool such as an air hammer.

It would be desirable to implement a specialty concrete remover.

SUMMARY

The invention concerns a concrete removing apparatus comprising a claw, a cleaving blade, and a bracket. The claw generally has a lower portion, a back portion, and an upper portion. The lower portion generally has a bottom surface, a sloped top surface, and extends forward from the back portion. The upper portion generally extends forward from the back portion partially overhanging the bottom portion and forming a locking notch defined by a front edge of the back portion, a bottom edge of the upper portion, and the top surface of the bottom portion. The cleaving blade is generally attached to a rear surface of the back portion of the claw. The bracket is generally mounted on a top surface of the upper portion of the claw and configured to pivotally connect the claw to an arm and a hydraulic cylinder of a construction machine.

BRIEF DESCRIPTION OF THE FIGURES

Embodiments of the invention will be apparent from the following detailed description and the appended claims and drawings in which:

DETAILED DESCRIPTION OF THE EMBODIMENTS

Embodiments of the present invention include providing a specialty concrete remover that may (i) include a cleaving blade configured to break pavement into sections, (ii) include a claw configured to passively lock onto a section of pavement allowing the section of pavement to be lifted to a truck, (iii) include a coupling for a frost tooth, (iv) be fabricated with steel plate, and/or (v) be removably attached to various construction machines.

Figure 1:
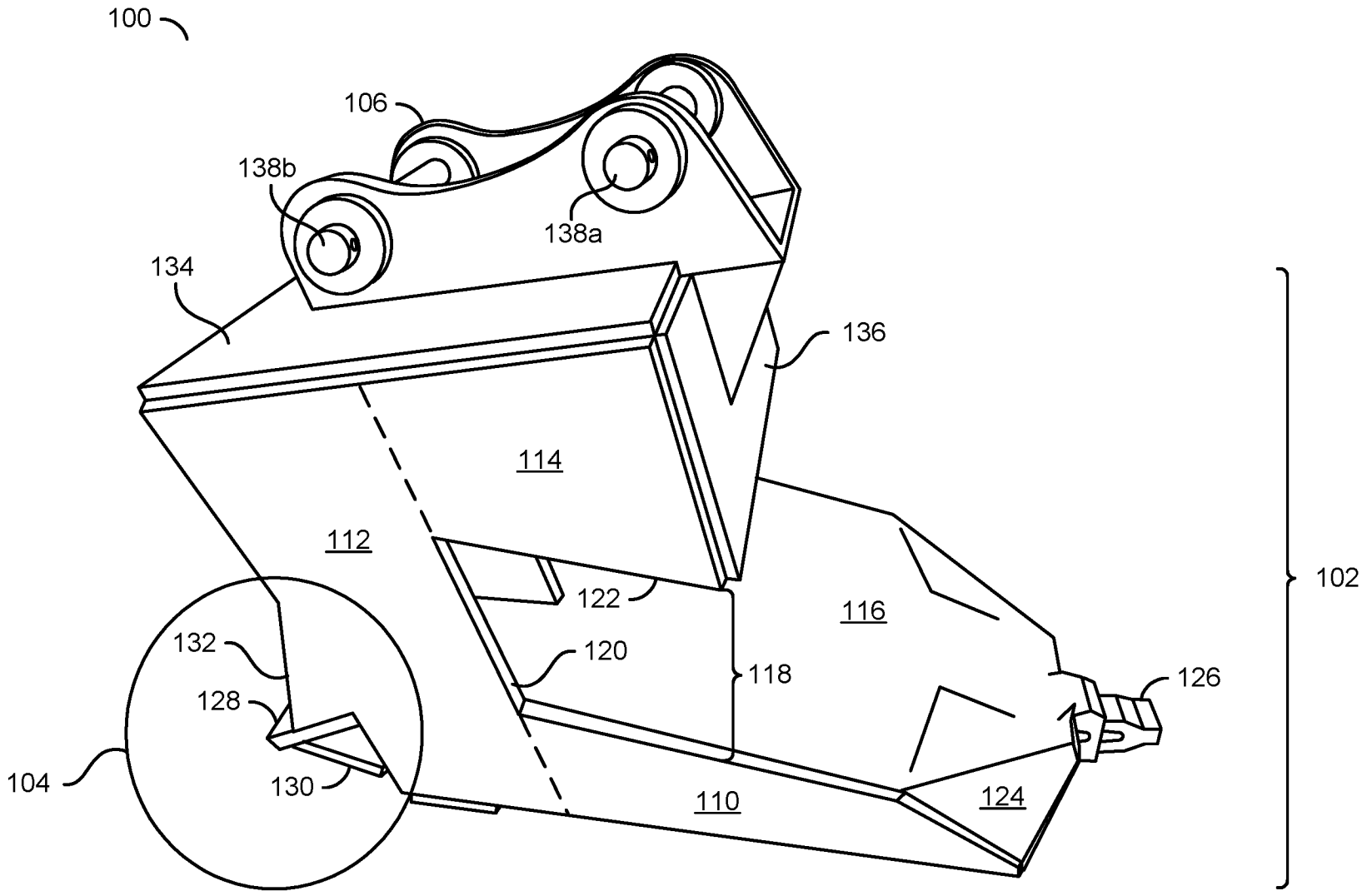
FIG. 1 is a diagram illustrating a specialty concrete remover in accordance with an example embodiment of the invention.

Referring to FIG. 1, a diagram is shown illustrating a specialty concrete removing apparatus in accordance with an example embodiment of the invention. In an example embodiment, a concrete removing apparatus (or remover) 100 generally comprises a claw 102, a cleaving blade assembly 104, and a bracket 106. The claw 102 generally has a "C" shape that may be divided into three sections: a lower front portion 110, a back (or middle) portion 112, and an upper front portion 114. The lower front portion 110 generally has a flat bottom surface (not visible) and a sloped top surface 116, and extends forward from the back portion 112. The upper front portion 114 generally extends forward from the back portion 112 and partially overhangs the lower front portion 110. The lower front portion 110, the back portion 112, and the upper front portion 114 generally form a locking notch 118. The locking notch 118 is generally defined by a front edge 120 of the back portion 112, a bottom edge 122 of the upper front portion 114, and the top surface 116 of the lower front portion 110. The front corners of the lower front portion 110 of the claw 102 generally have a bevel 124. A front edge of the lower front portion 110 of the claw 102 may have a frost tooth or coupling for a frost tooth 126.

The cleaving blade assembly 104 is generally attached at a point on a lower rear surface of the back portion 112 of the claw 102. The cleaving blade assembly 104 generally comprises a first section of steel plate 128 extending orthogonally from the rear surface of the back portion 112. The section of steel plate 128 is generally supported on a first side by a second section of steel plate 130. In an example, the second section of steel plate 130 may be welded at an angle between the first side of the steel plate 128 and the rear surface of the back portion 112. The first section of steel plate 128 is generally supported on a second side by a number of triangular features 132. In an example, the triangular features 132 may be portions of steel plates forming a first side and a second side of the claw 102.

The bracket 106 is generally attached (e.g., welded) to a first steel plate 134 forming a top surface of the claw 102 and a second steel plate 136 forming a front surface of the upper front portion 114 of the claw 102. In one example, the steel plate 136 may extend from the steel plate 134 to the bottom edge of the upper front portion 114. In one example, the steel plate 136 may extend from the steel plate 134 to the bottom edge of the upper front portion 114. In another example, the steel plate 136 may extend partially from the steel plate 134 toward the bottom edge of the upper front portion 114. In various embodiments, the steel plate 136 may be dimensioned to provide a surface for providing additional support for the bracket 106.

In various embodiments, the bracket 106 is generally configured to mate with a particular type or brand of construction machine. In an example embodiment, the bracket 106 may comprise a first pivot shaft 138*a* and a second pivot shaft 138*b*. The pivot shafts 138*a* and 138*b* are generally configured to pivotally connect the bracket 106 and attached claw 102 to an arm and a hydraulic cylinder of a construction machine (e.g., back hoe, excavator, etc.).

Figure 2:
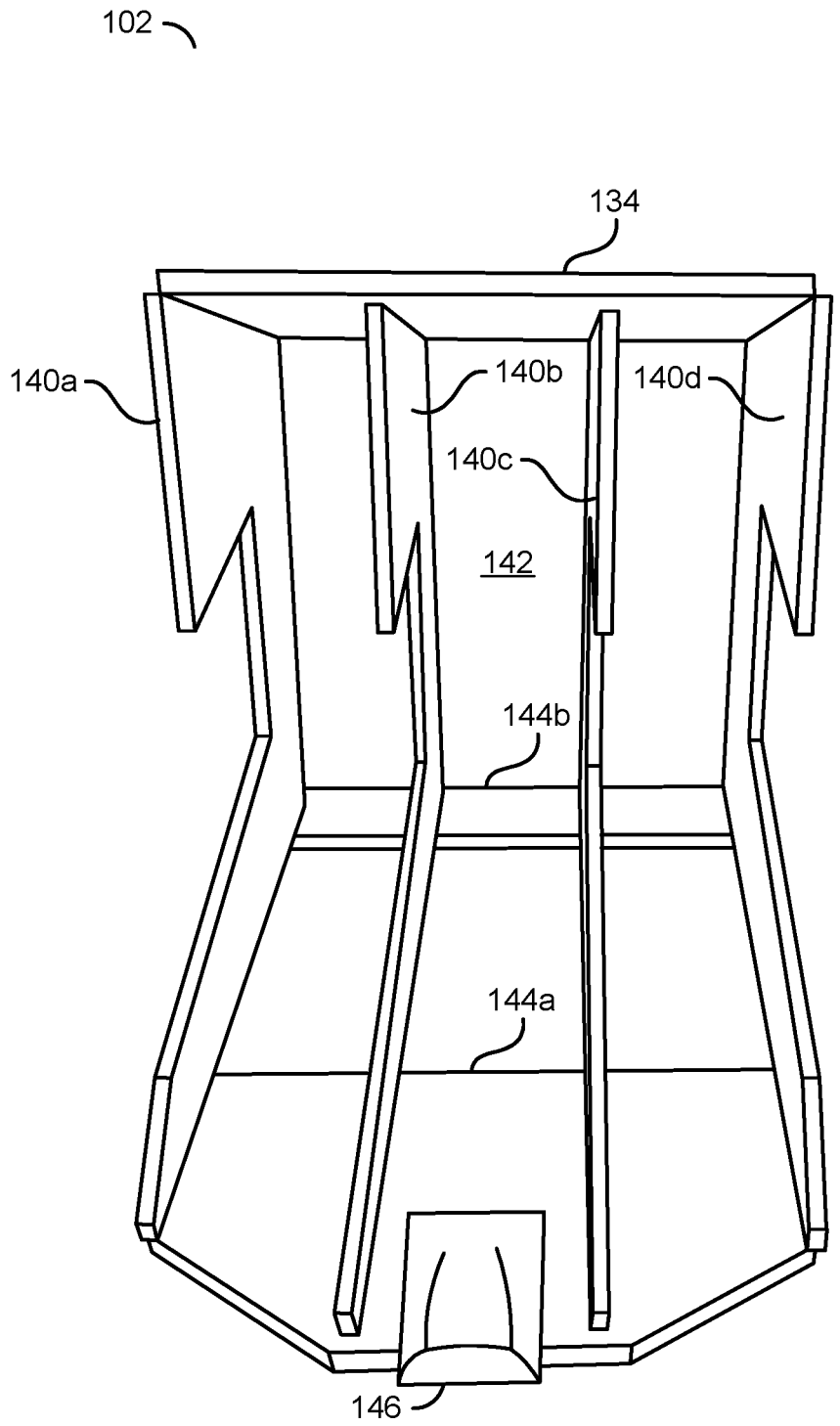
FIG. 2 is a diagram illustrating internal ribs of a specialty concrete remover of FIG. 1.

Referring to FIG. 2, a diagram is shown illustrating an internal structure of a specialty concrete remover in accordance with an example embodiment of the invention. In an example embodiment, the claw 102 of the concrete removing apparatus 100 may comprise a plurality of ribs 140*a*-140*n*. In an example, the claw 102 may be implemented with four ribs 140*a*-140*d*. In an example, the ribs 140*a* and 140*n* generally form the sides of the claw 102 and the ribs 140*b*-140(*n*−1) form the internal structure of the claw 102. Top edges of the ribs 140*a*-140*n* are generally joined together by the steel plate 134. A back edge of each of the ribs 140*a*-140*n* may be joined together by a steel plate 142. A bottom edge of each of the ribs 140*a*-140*n* may be joined together by a front steel plate 144*a* and bottom rear steel plate 144*b*. In an example, the bottom front steel plate 144*a* and the bottom rear steel plate 144*b* may be part of (or attached to) a single bottom steel plate.

The ribs 140*a* and 140*n* (140*d* in FIG. 2) generally form side walls of the claw 102. The bottom front plate 144*a* generally ties the front of the ribs 140*a*-140*n* together and generally provides an attachment (or coupling) 146 for the frost tooth 126. The bottom rear plate 144*b* generally ties the rear bottom of the ribs 140*a*-140*n* together. In an example embodiment, the ribs 140*a*-10*d* may be arranged approximately eleven inches apart. In an example, the bottom front steel plate 144*a* may be implemented with beveled corners. In an example, the top steel plate 134 may be implemented as a steel plate approximately thirty-five inches square. In various embodiments, the claw 102 may comprise sections constructed from steel plate having a thickness of approximately one inch to one and one-half inches.

Figure 3:
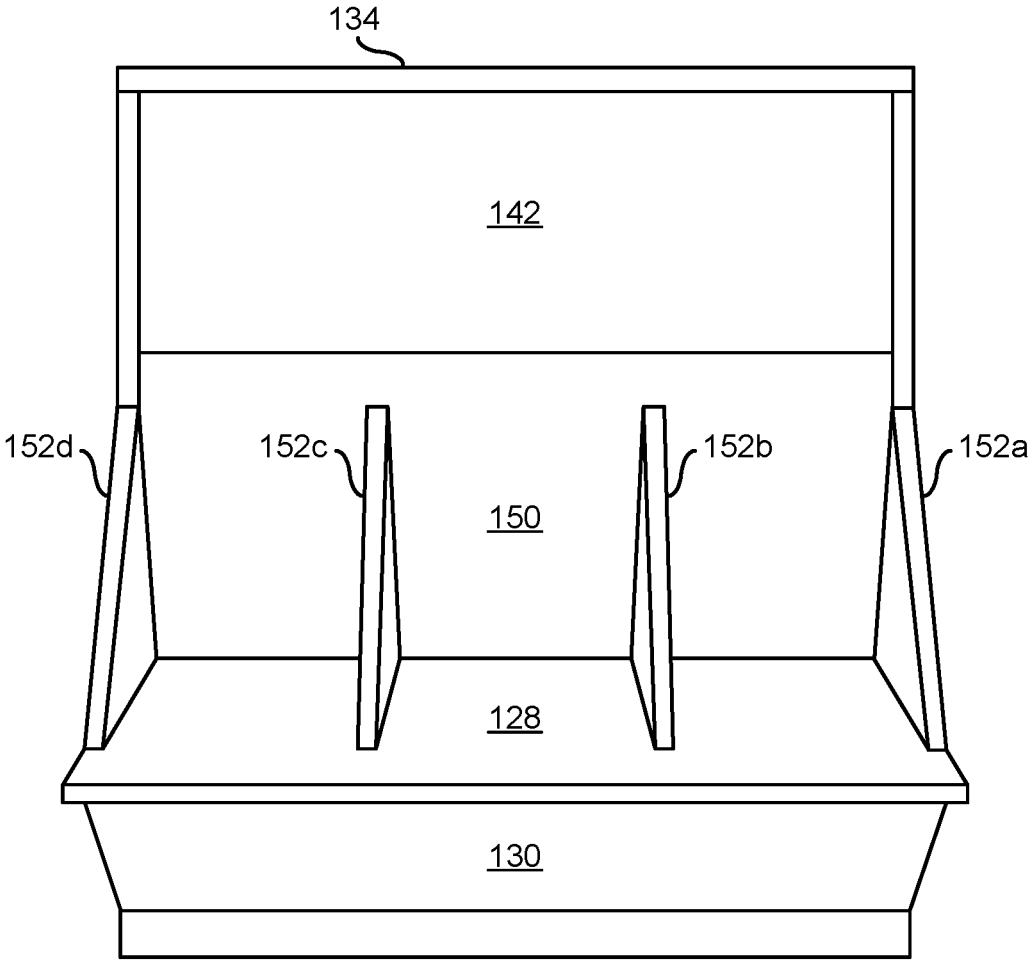
FIG. 3 is a diagram illustrating an example implementation of a cleaving blade assembly of the specialty concrete remover of FIG. 1.

Referring to FIG. 3, a diagram is shown illustrating an example implementation of the cleaving blade assembly 104 of the specialty concrete remover 100 of FIG. 1. In an example, a steel plate 150 may be attached to the ribs 140*a*-140*n* between the back plate 142 and the second surface of the cleaver blade 128. In an example, the second surface of the cleaver blade 128 is generally supported by triangular sections 152*a*-152*n* of the ribs 140*a*-140*n*, which extend past the steel plate 150. The parts of the cleaver blade assembly 104 are generally welded together for strength.

Figure 4:
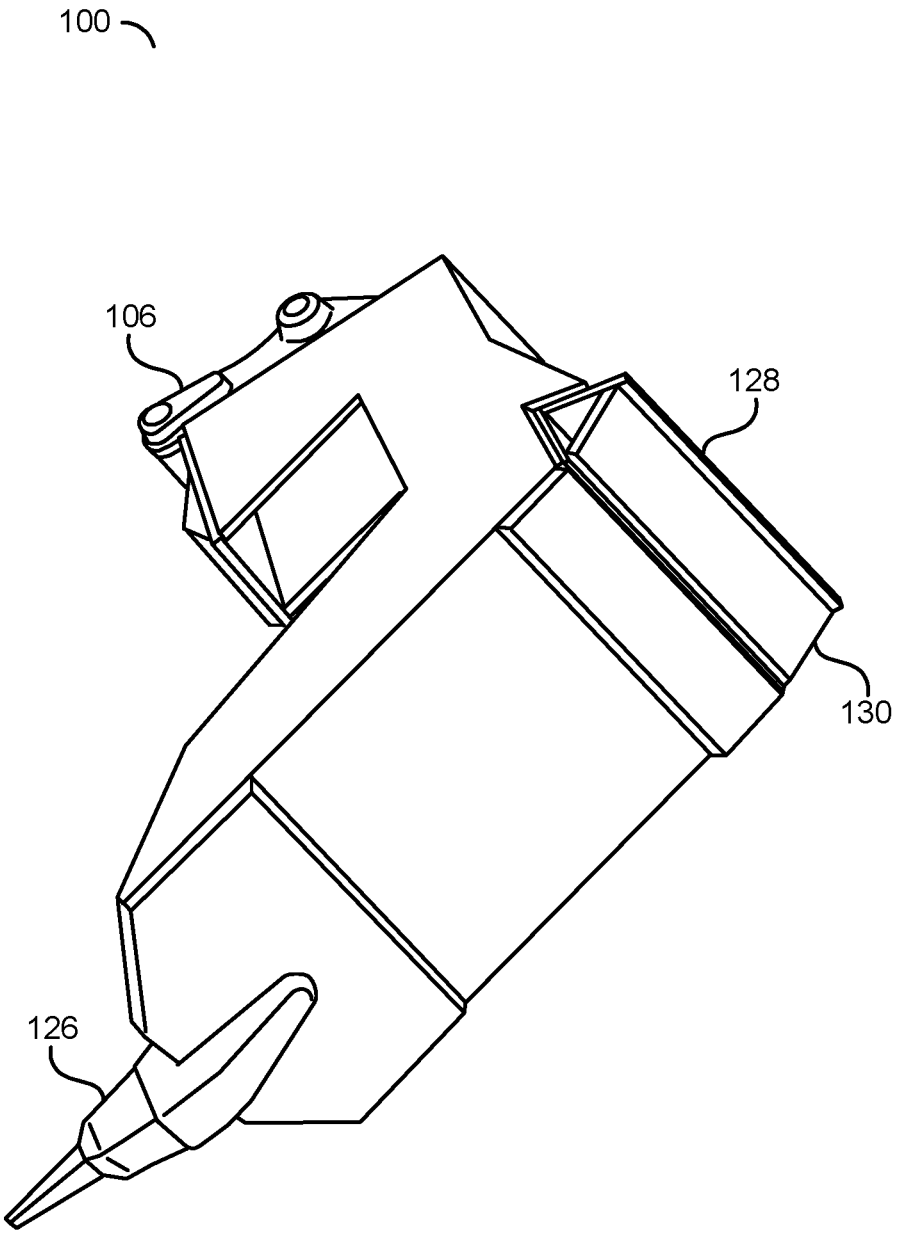
FIG. 4 is a diagram illustrating a bottom view of the specialty concrete remover of FIG. 1 with a frost tooth attachment in accordance with an example embodiment of the invention.

Referring to FIG. 4, a diagram is shown illustrating a bottom perspective view of the specialty concrete remover 100 of FIG. 1 with a frost tooth 126 attached in accordance with an example embodiment of the invention.

Figure 5:
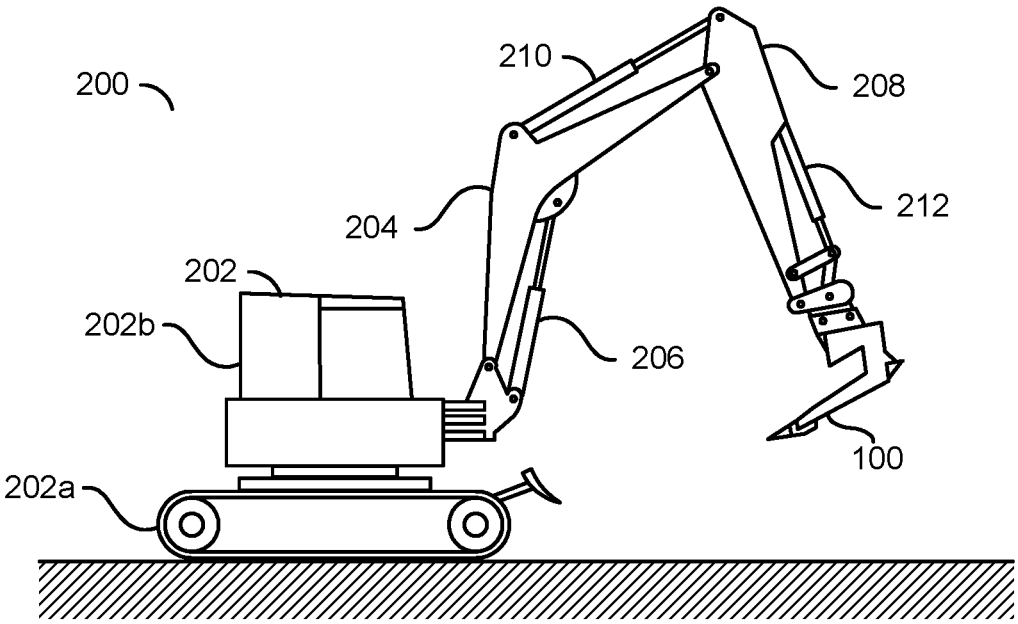
FIG. 5 is a diagram illustrating a side elevation view of the specialty concrete remover of FIG. 1 with the frost tooth attachment assembled to a front end assembly of an excavating machine.
Figure 6:
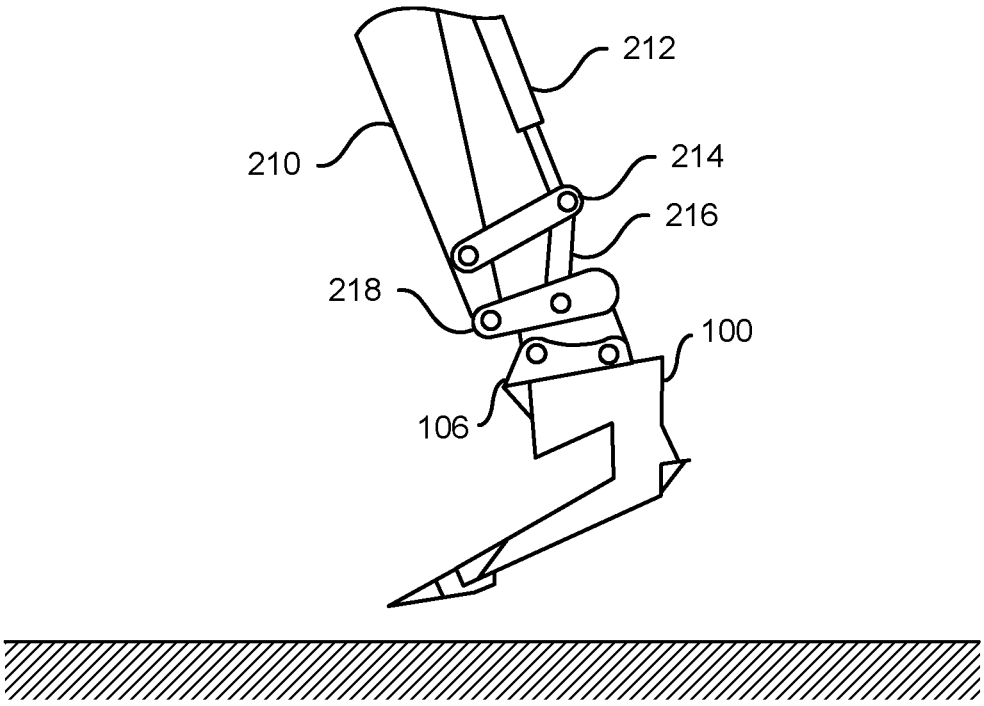
FIG. 6 is a diagram illustrating a side view of the front end assembly of the excavating machine of FIG. 5 embodying the specialty concrete remover with a frost tooth attachment in accordance with an example embodiment of the invention.
Figure 7:
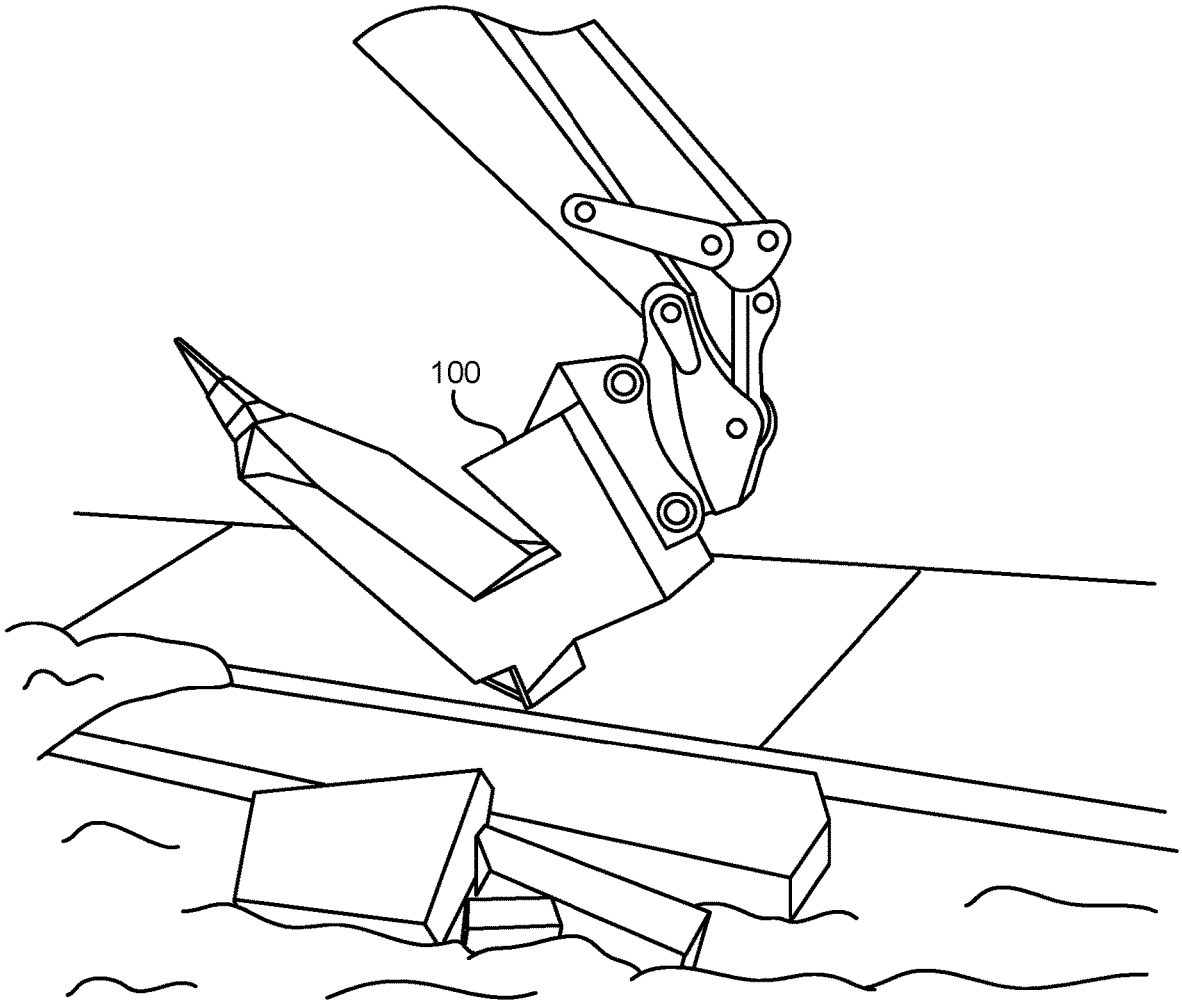
FIGS. 7-13 are diagrams illustrating example operations of the specialty concrete remover of FIG. 1.
Figure 8:
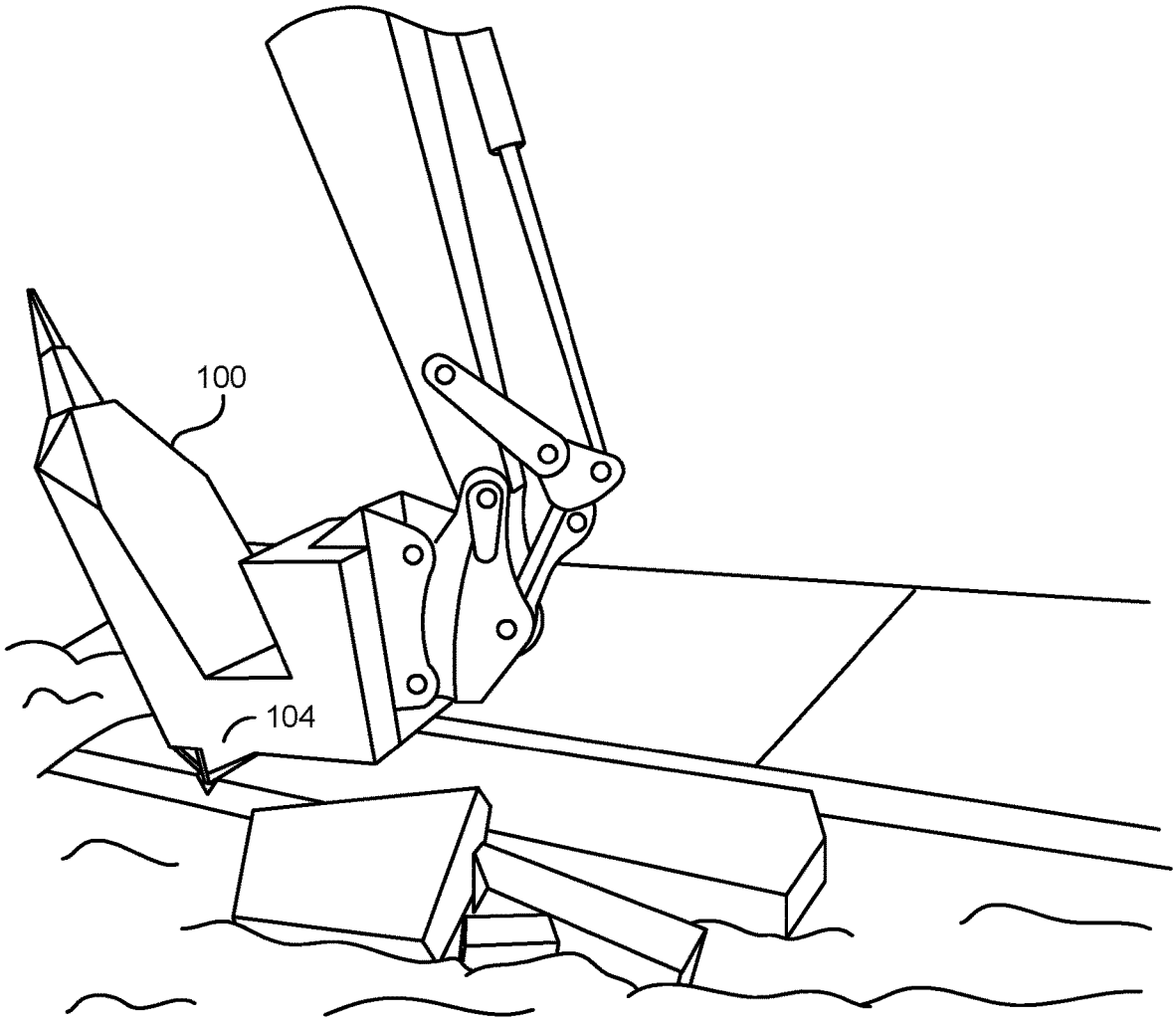
Figure 9:
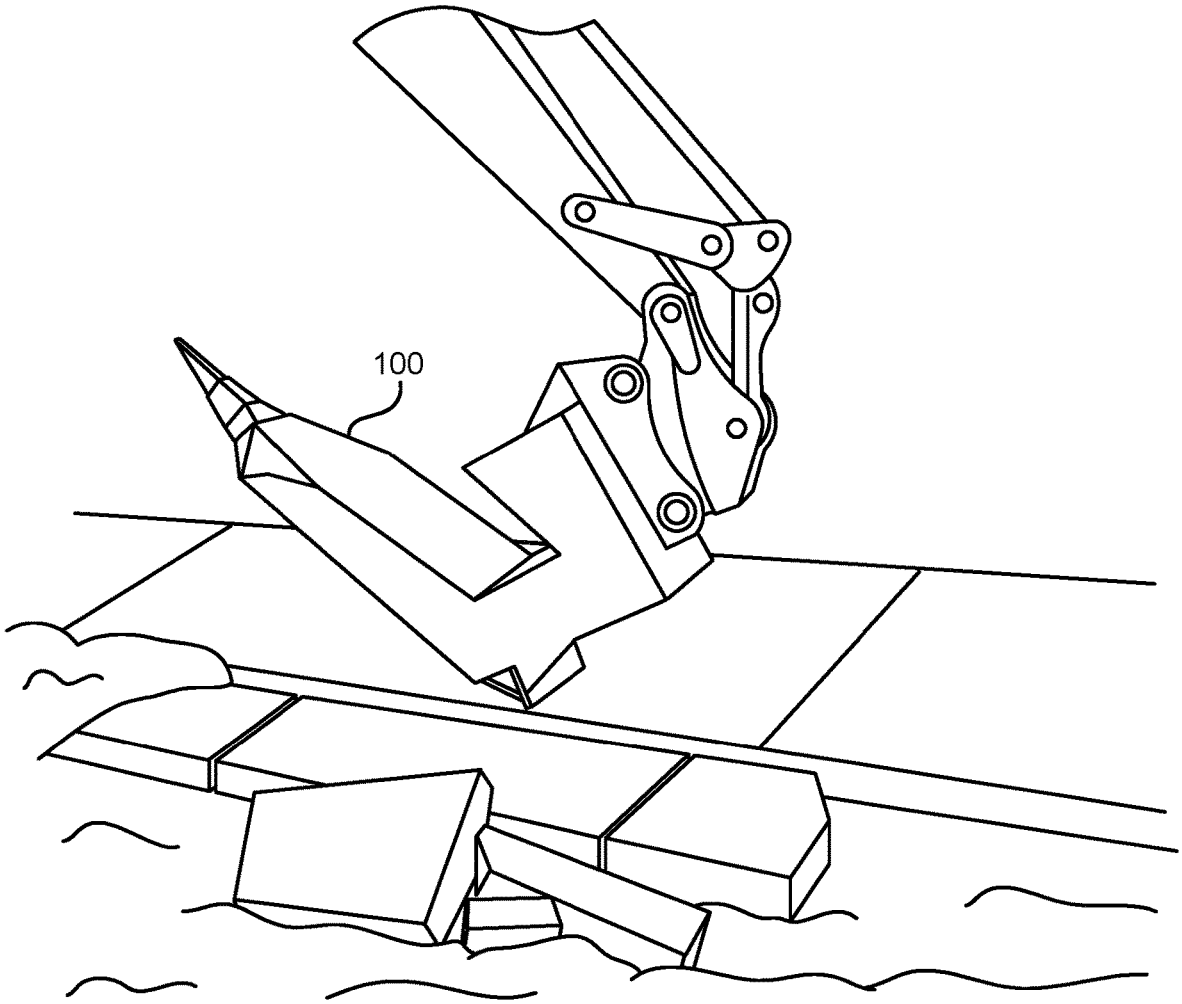

Referring to FIGS. 5 and 6, diagrams are shown illustrating a side elevation view of the specialty concrete remover 100 of FIG. 1 with the frost tooth attachment 126 assembled to a front end assembly of an excavating machine. In an example, an excavating machine (or excavator) 200 may have a main structure 202 comprising a lower traveling structure 202*a* and an upper turret structure 202*b*. A working machine, which is swingably attached to the front side of the main structure 202, may comprise various parts including, but not limited to, a boom 204, a boom cylinder 206, an arm (or handle) 208, an arm cylinder 210, a hydraulic cylinder 212, an intermediate (or support) link 214, and a bucket (or connecting) link 216. Hydraulic shovels, having the described constructions, are widely used for various purposes including excavation. The arm 210, the bucket link 216, and a bracket 218 may be pivotally connected (e.g., by the pivot shafts or connecting pins 138*a* and 138*b*) to the specialty concrete remover 100 of FIG. 1.

Referring to FIG. 6, a diagram is shown illustrating a side view of the front end assembly of the excavating machine 200 of FIG. 5 embodying the specialty concrete remover 100 with the frost tooth attachment 126 in accordance with an example embodiment of the invention. The hydraulic cylinder 212 is generally operated in a contracting direction so that the specialty concrete remover 100 is moved forwardly (e.g., a release position), through the action of the intermediate link 214, the bucket link 216, and the brackets 106 and 218. The hydraulic cylinder 212 is generally operated in an extending direction so that the specialty concrete remover 100 is moved rearwardly (e.g., a cleaving position with the frost tooth rotated up parallel to the arm 210), through the action of the intermediate link 214, the bucket link 216, and the brackets 106 and 218. The specialty concrete remover 100 generally eliminates laborious work which otherwise may be required for detaching a bucket from the working machine of the excavator and mounting a breaker (or air-hammer) as an independent attachment, thus reducing the man-hours required in replacement work.

Referring to FIGS. 7-13, diagrams are shown illustrating example operations of the specialty concrete remover 100 of FIG. 1. In an example, the specialty concrete remover 100 may be moved rearwardly into the cleaving position for breaking up pavement into a number of sections using the cleaving blade assembly 104 of the specialty concrete remover 100 (e.g., FIGS. 7-8). In an example, the concrete removing apparatus 100 may be rotated into a first position allowing the cleaving blade assembly 104 to be directed toward the pavement to be broken. Bringing weight of the arm of the construction machine and the concrete removing apparatus 100 down upon the pavement generally causing the cleaving blade assembly 104 to cleave (break) the pavement. When the specialty concrete remover 100 is in the cleaving position, the cleaving blade assembly 104 of the specialty concrete remover 100 may be repeatedly brought down at various positions on the pavement to break the section of pavement into a number of sections (or segments).

Figure 10:
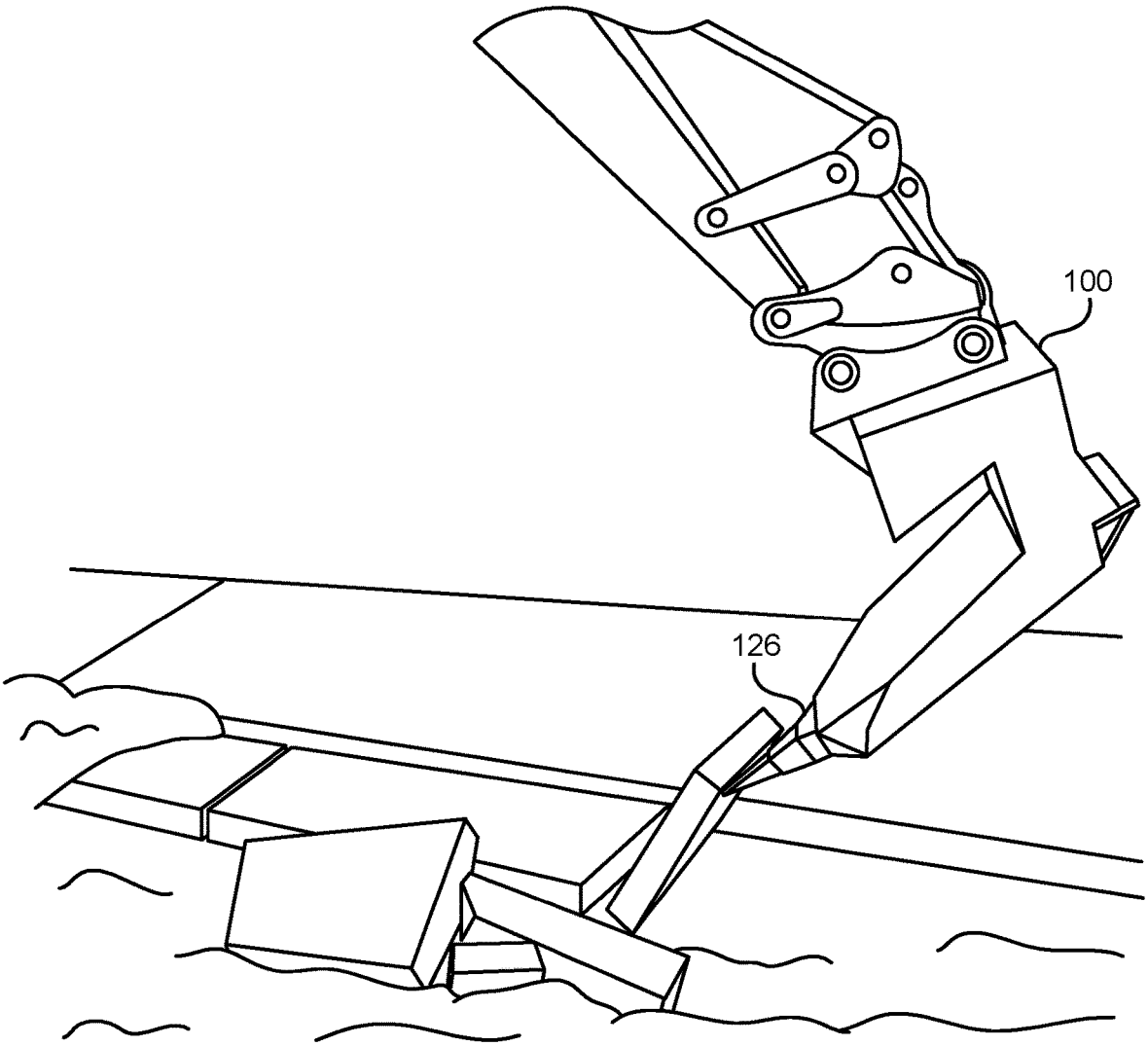
Figure 11:
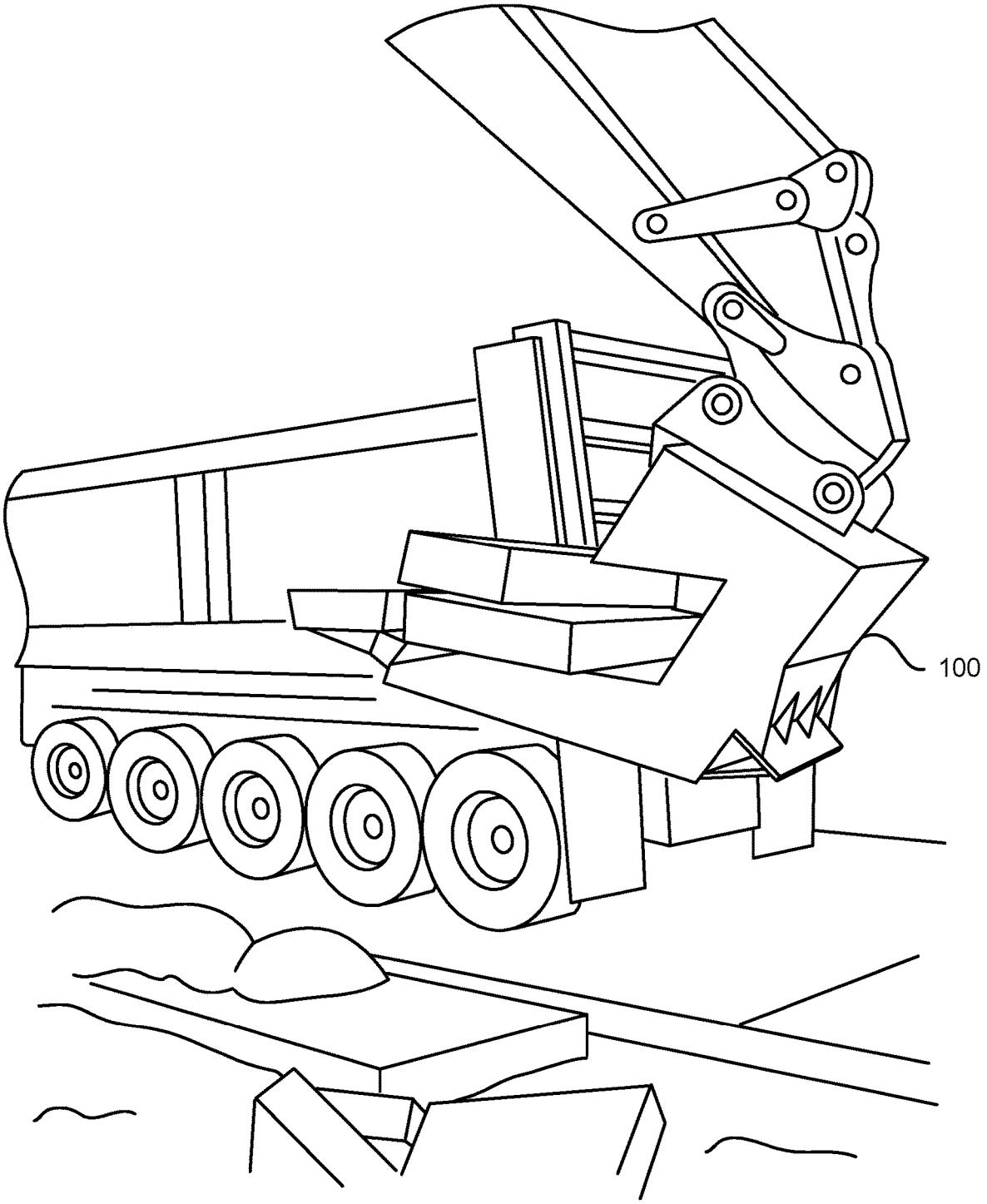
Figure 12:
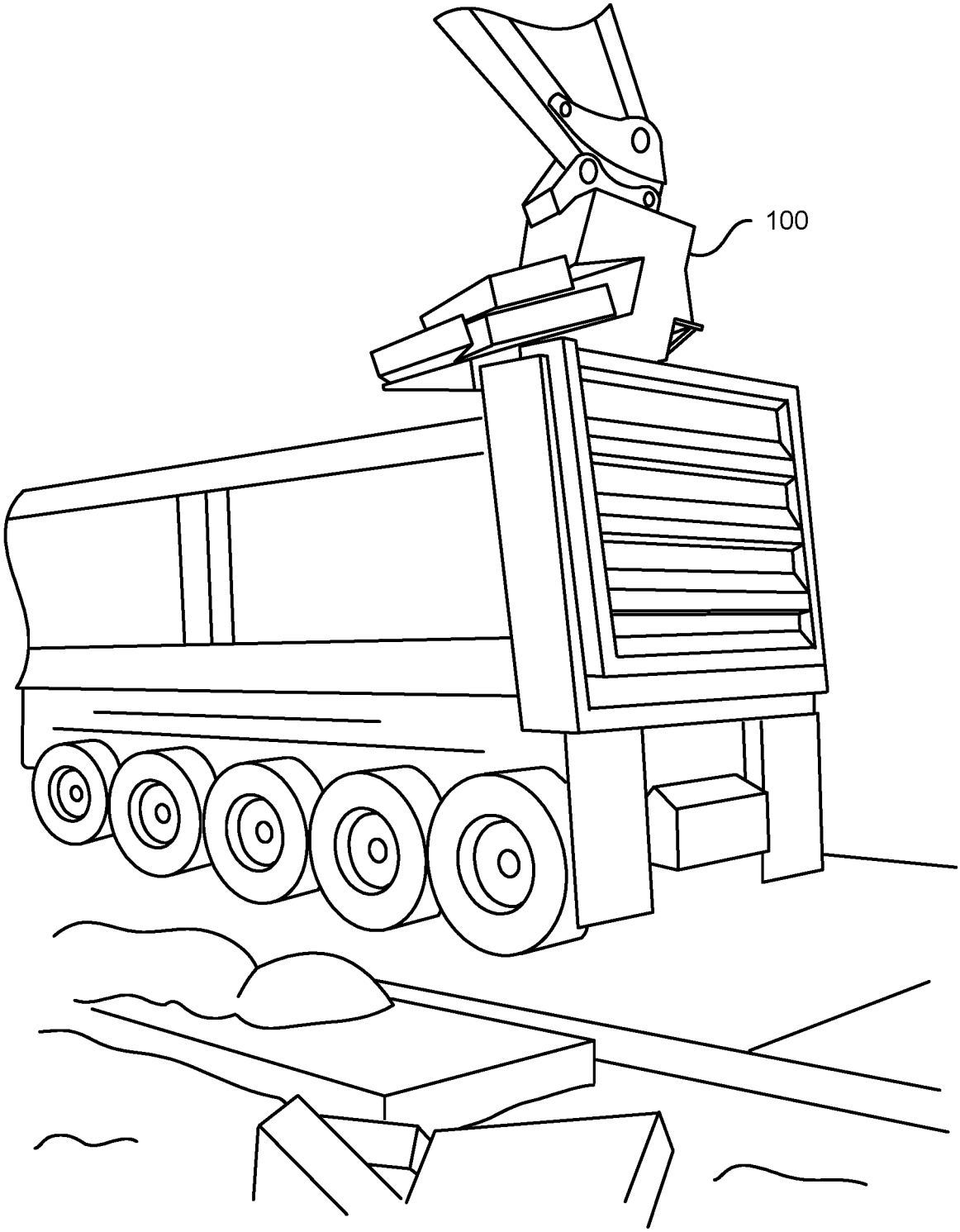
Figure 13:
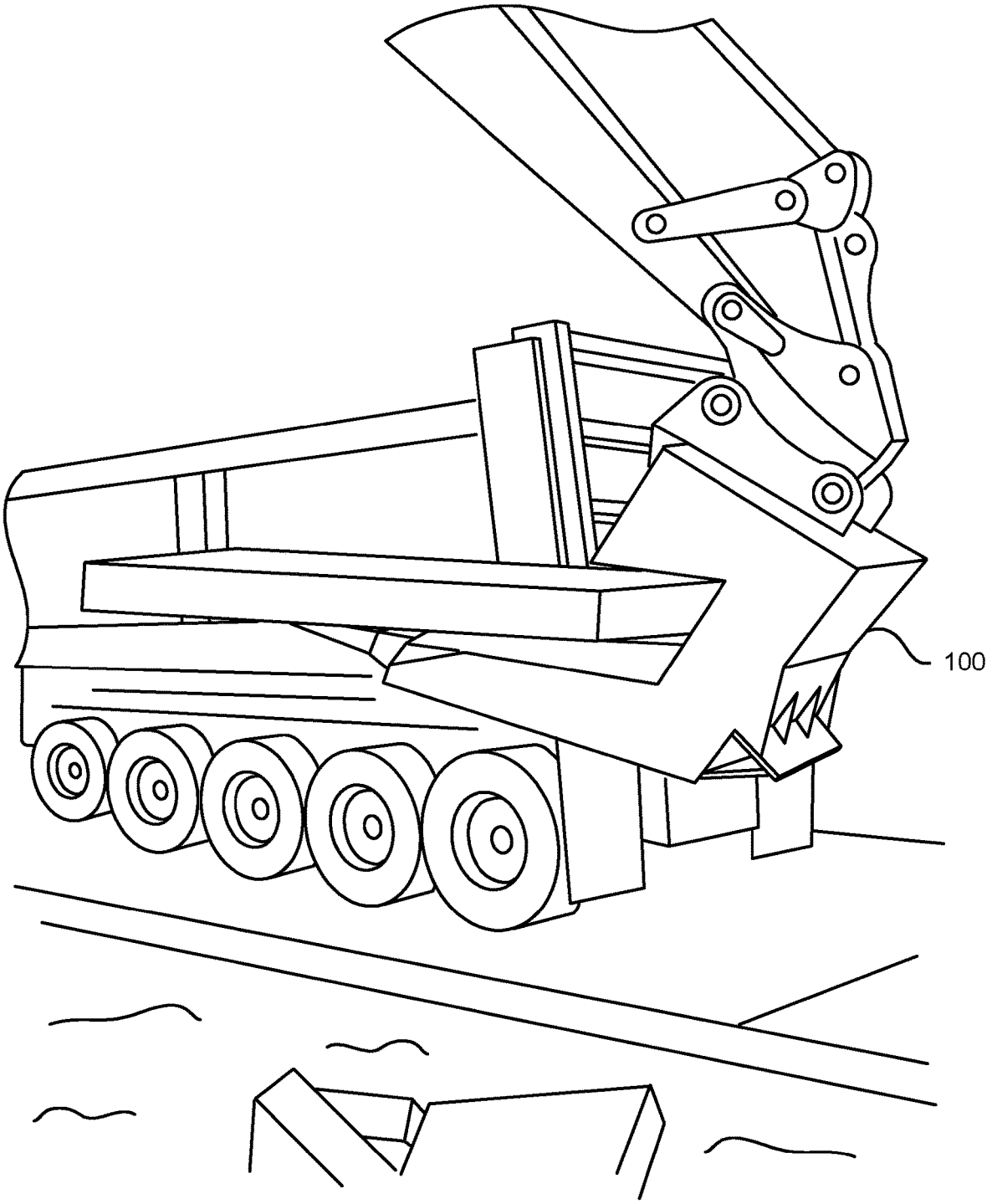

When the pavement has been broken into the number of segments (e.g., FIG. 9), the specialty concrete remover 100 may be moved forwardly into positions to manipulate (e.g., pick up, stack, lift, and dump) the pavement sections (e.g., FIGS. 10-12). In various steps, the lower front portion 110 (e.g., with the frost tooth attachment 126) of the claw 102 of the specialty concrete remover 100 may be slid under one of the sections of the pavement (e.g., FIG. 10) and used to manipulate the section of pavement. In one example, the section may then be stacked on another section or sections and lifted on the lower front portion 110 of the claw 102 of the specialty concrete remover 100 and dumped into a truck (e.g., FIGS. 10-12).

In another example (e.g., FIG. 13), the lower front portion 110 of the claw 102 of the specialty concrete remover 100 may be slid under a large section of pavement until the pavement is locked (e.g., in a cantilevered position) in the locking notch 118. The section of pavement then may be lifted on the lower front portion 110 of the claw 102 of the specialty concrete remover 100 and dumped into a truck. In an example, the specialty concrete remover 100 may be used to remove pavement with thicknesses as large as approximately 12 to 14 inches.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. A concrete removing apparatus comprising:

a claw having a lower portion, a back portion, and an upper portion, wherein the claw comprises a plurality of ribs and two of the ribs form sides of the claw, the lower portion has a bottom surface, a sloped top surface, and extends forward from the back portion, the upper portion extends forward from the back portion partially overhanging the lower portion and forming a locking notch defined by a front edge of the back portion, a bottom edge of the upper portion, and the sloped top surface of the lower portion;

a cleaving blade attached to a rear surface of the back portion of the claw, wherein the cleaving blade is attached at a lower rear surface of the back portion of the claw, extends orthogonally from the rear surface of the back portion of the claw, is supported on a first side by a section of steel plate welded at an angle between the first side of the cleaving blade and the rear surface of the back portion of the claw, and is supported on a second side by a triangular feature of each of the plurality of ribs; and a bracket mounted on a top surface of the upper portion of the claw and configured to pivotally connect the bracket to an arm and a hydraulic cylinder of a construction machine.

2. The concrete removing apparatus according to claim 1, wherein said locking notch is configured to passively lock onto a section of pavement while the section of pavement is being lifted.

3. The concrete removing apparatus according to claim 1, wherein a first height of the locking notch along the front edge of the back portion of the claw is greater than a second height of the locking notch between the bottom edge of the upper portion at a front edge of the upper portion and the sloped top surface of the lower portion.

4. The concrete removing apparatus according to claim 3, wherein the first height and the second height of the locking notch are configured to allow the bottom edge of the upper portion of the claw to lock onto a section of pavement having a thickness up to fifteen inches.

5. The concrete removing apparatus according to claim 3, wherein the first height and the second height of the locking notch are configured to allow the bottom edge of the upper portion of the claw to lock onto a section of pavement cantilevered on the sloped top surface of the lower portion of the claw.

6. The concrete removing apparatus according to claim 1, wherein the lower portion of the claw further comprises a coupling configured to connect to a frost tooth.

7. The concrete removing apparatus according to claim 1, wherein each front corner of the lower portion of the claw further comprises a bevel.

8. The concrete removing apparatus according to claim 1, wherein said bracket comprises a first pivot shaft and a second pivot shaft.

9. The concrete removing apparatus according to claim 1, wherein said bracket is welded to the top surface of the upper portion of the claw.

10. The concrete removing apparatus according to claim 1, wherein said claw is constructed from steel plate having a thickness from one inch to one and one-quarter inches.

11. A method of removing pavement comprising:

mounting a concrete removing apparatus to a construction machine, wherein said concrete removing apparatus comprises (i) a claw having a lower portion, a back portion, and an upper portion, wherein the claw comprises a plurality of ribs and two of the ribs form sides of the claw, the lower portion has a bottom surface, a sloped top surface, and extends forward from the back portion, the upper portion extends forward from the back portion partially overhanging the lower portion and forming a locking notch defined by a front edge of the back portion, a bottom edge of the upper portion, and the sloped top surface of the lower portion, (ii) a cleaving blade attached to a rear surface of the back portion of the claw, wherein the cleaving blade is attached at a lower rear surface of the back portion of the claw, extends orthogonally from the rear surface of the back portion of the claw, is supported on a first side by a section of steel plate welded at an angle between the first side of the cleaving blade and the rear surface of the back portion of the claw, and is supported on a second side by a triangular feature of each of the plurality of ribs, and (iii) a bracket mounted on a top surface of the upper portion of the claw and configured to pivotally connect the bracket to an arm and a hydraulic cylinder of the construction machine;

breaking up the pavement into a number of sections using the cleaving blade of said concrete removing apparatus;

sliding said lower portion of said claw of said concrete removing apparatus under a section of pavement of the number of sections of the pavement;

lifting the section of pavement on the lower portion of the claw of the concrete removing apparatus; and placing the section of pavement on the lower portion of the claw into a truck.

12. The method according to claim 11, further comprising:

rotating said concrete removing apparatus to a first position allowing the cleaving blade to be directed toward the pavement to be broken; and bringing said concrete removing apparatus down upon the pavement causing the cleaving blade to break the pavement.

13. The method according to claim 12, further comprising:

rotating said concrete removing apparatus to a second position allowing said lower portion of said claw of said concrete removing apparatus to be slid under one of the number of sections of the pavement.

* * * * *